US005876045A

United States Patent [19]

Acuna, Jr.

[11] Patent Number: 5,876,045

[45] Date of Patent: Mar. 2, 1999

[54] ANGULARLY ADJUSTABLE SNOWBOARD BOOT BINDING

[76] Inventor: Peter R. Acuna, Jr., 200 S. Garfield Ave., Alhambra, Calif. 91801

[21] Appl. No.: 566,942

[22] Filed: Dec. 4, 1995

[51] Int. Cl.[6] ..... A63C 9/00

[52] U.S. Cl. ..... 280/14.2; 280/607

[58] Field of Search ..... 280/607, 617, 280/618, 626, 629, 633, 634, 14.2

[56] References Cited

U.S. PATENT DOCUMENTS

| | | | |
|---|---|---|---|
| 5,021,017 | 6/1991 | Ott . | |
| 5,236,216 | 8/1993 | Ratzek | 280/607 |
| 5,261,689 | 11/1993 | Carpenter et al. . | |
| 5,277,635 | 1/1994 | Gillis | 280/14.2 |
| 5,354,088 | 10/1994 | Vetter et al. . | |
| 5,499,837 | 3/1996 | Hale et al. | 280/618 |
| 5,586,779 | 12/1996 | Dawes et al. | 280/618 |
| 5,667,237 | 9/1997 | Lauer | 280/607 |

FOREIGN PATENT DOCUMENTS

| | | | |
|---|---|---|---|
| 432588 | 6/1991 | European Pat. Off. | 280/607 |
| 4034099 | 8/1991 | Germany | 280/618 |
| 9209339 | 6/1992 | WIPO | 280/14.2 |

*Primary Examiner*—Robert J. Oberleitner
*Assistant Examiner*—Faye M. Fleming
*Attorney, Agent, or Firm*—Sheldon & Mak

[57] ABSTRACT

An adjustable snowboard boot binding comprising a base disc, a main body, a top disc and one or more levers. The base disc is mounted to the top of a snowboard. The main body is sandwiched between the top disc and the base disc. The lever is hand-manipulable, allowing the snowboarder to adjust the angle of the boot binding with respect to the longitudinal axis of the snowboard without the need for tools. With the lever in the open position, the main body of the boot binding is free to rotate about an axis normal to the snowboard. With the lever in the closed position, the main body is rigid, allowing the snowboarder to maneuver the snowboard when riding.

8 Claims, 7 Drawing Sheets

ANGULARLY ADJUSTABLE SNOWBOARD BOOT BINDING

BACKGROUND OF THE INVENTION

This invention relates generally to a snowboard boot binding. More particularly, it relates to a binding that can be angularly adjusted both quickly and easily without the need for a tool. In one embodiment of the invention, the binding can be angularly adjusted while the rider's boot is still in the binding.

The sport of snowboarding has been practiced now for numerous years and has gained tremendous popularity across the country and throughout the world. Similar to skiing, a snowboarder wears snowboarding boots that are firmly held into boot bindings. The bindings are rigidly attached to the board to allow the user to properly maneuver the board when riding. Different from skiing, however, the snowboarder places both feet onto a single board, one in front of the other, and stands at an angle to the direction of travel.

A snowboarder will often desire to change the angle of the front and/or back foot with respect to the longitudinal axis of the board. Different angular foot positions are desired for speed, slalom, free-style or acrobatics. Depending on the snow or weather conditions, the person's skill level, or the particular attitude of a given snowboarder, the position of each foot can change numerous times during a single outing.

In the case of a skateboard or surfboard, changing foot positions is easy—just pick up a foot and move it. With a snowboard, however, the rider's feet are rigidly mounted into the bindings, preventing any such movement. Before the present invention, there was not a snowboard boot binding that was rigidly attached to the board, but that could be adjusted to any angle quickly and easily, without the need for tools.

At present, in order for a snowboarder to adjust the angle of either foot, the boot must be removed from the binding and a tool must be used to make the adjustment. An example of this is shown in U.S. Pat. No. 5,261,689 to Carpenter et al. Where the adjustment requires the loosening of screws, the snowboarder runs the significant risk of losing screws and, along with them, the ability to ride at all. The rider also runs the risk of stripping the head of the screw, preventing future adjustments until the screw can be removed.

A snowboarder without the required tool must ride to the bottom of the mountain in order to make adjustments. Each trip to the bottom of the mountain wastes valuable snowboarding time. If an adjustment is not correct, the snowboarder must return to the bottom of the mountain to make a correction.

One attempt at remedying this problem is shown at U.S. Pat. No. 5,345,088 to Vetter et al. While improving the technology by allowing a snowboarder to quickly disengage the binding from the board, this invention is restricted in that the angular positioning of the foot is limited to a few angles. In order to adjust the foot position to most angles, the boot must be removed from the binding and the binding must be adjusted with a tool, as in the case of the Carpenter invention above.

SUMMARY OF THE INVENTION

It is an object of this invention to provide a snowboard boot binding that can be angularly adjusted by the rider both quickly and easily. It is a further object of this invention to provide a snowboard boot binding that can be angularly adjusted by the rider while the rider's foot remains in the binding.

In order to perform these functions and to overcome the above problems, the invention incorporates a boot binding with a main body that is engaged from below by a base disc and from above by a top disc. The two discs share a common centerline about which the main body can rotate. The base disk is rigidly mounted to the top surface of a snowboard with screws or other fastening means. The orientation of the main body between the top disc and the mounted, base disc allows the boot binding main body to rotate about an axis normal to the surface of the snowboard, while remaining rigid in all other directions. The boot binding main body is locked into a selected angular position using one or more hand-manipulated levers.

In the preferred embodiment, the top disc, main body and base disc are fabricated from rigid plastic and the fasteners from metal. However, other materials with similar properties can be substituted to vary the invention's weight, strength, flexibility or other characteristics.

In a first embodiment of the invention, the hand-manipulated lever is on top and, generally, in the center of the top disc. The top lever is attached to a vertical shaft that runs through the common centerline of the two discs. In the open position, the top lever allows the top and base discs to separate, freeing the boot binding main body to rotate freely. A spring may be placed beneath the top disc to facilitate the separation of the parts. Once the binding is in the desired angular position, the rider can move the top lever into the closed position.

In the closed position, a cam on the top lever forces the top disc and the base disc together. Teeth between the boot binding main body and the top disc and/or the base disc prevent the boot binding main body from rotating. In this position, the lever is flush with the top of the top disc so as not to interfere with the rider's boot. During operation, the rider's boot prevents the top lever from opening.

In a second embodiment of the invention, the hand-manipulated lever lies on the side of the boot binding main body. The invention can be built with one or two side levers. Where two side levers are used, the two oppose each other, one on each side of the boot binding main body.

Attached to each side lever is a shaft passing through a channel in the boot binding main body. The shaft terminates in an orifice in either the top disc or the base disc. In the open position, the shaft is drawn out of the disc. This allows the boot binding main body to rotate freely. After the rider rotates the binding into the desired angular position, the side lever can be moved into the closed position. In the closed position, the shaft is moved into one of a number of orifices in the disc, preventing the boot binding main body from rotating out of the desired position.

DESCRIPTION OF THE PREFERRED EMBODIMENTS

Figure 1:
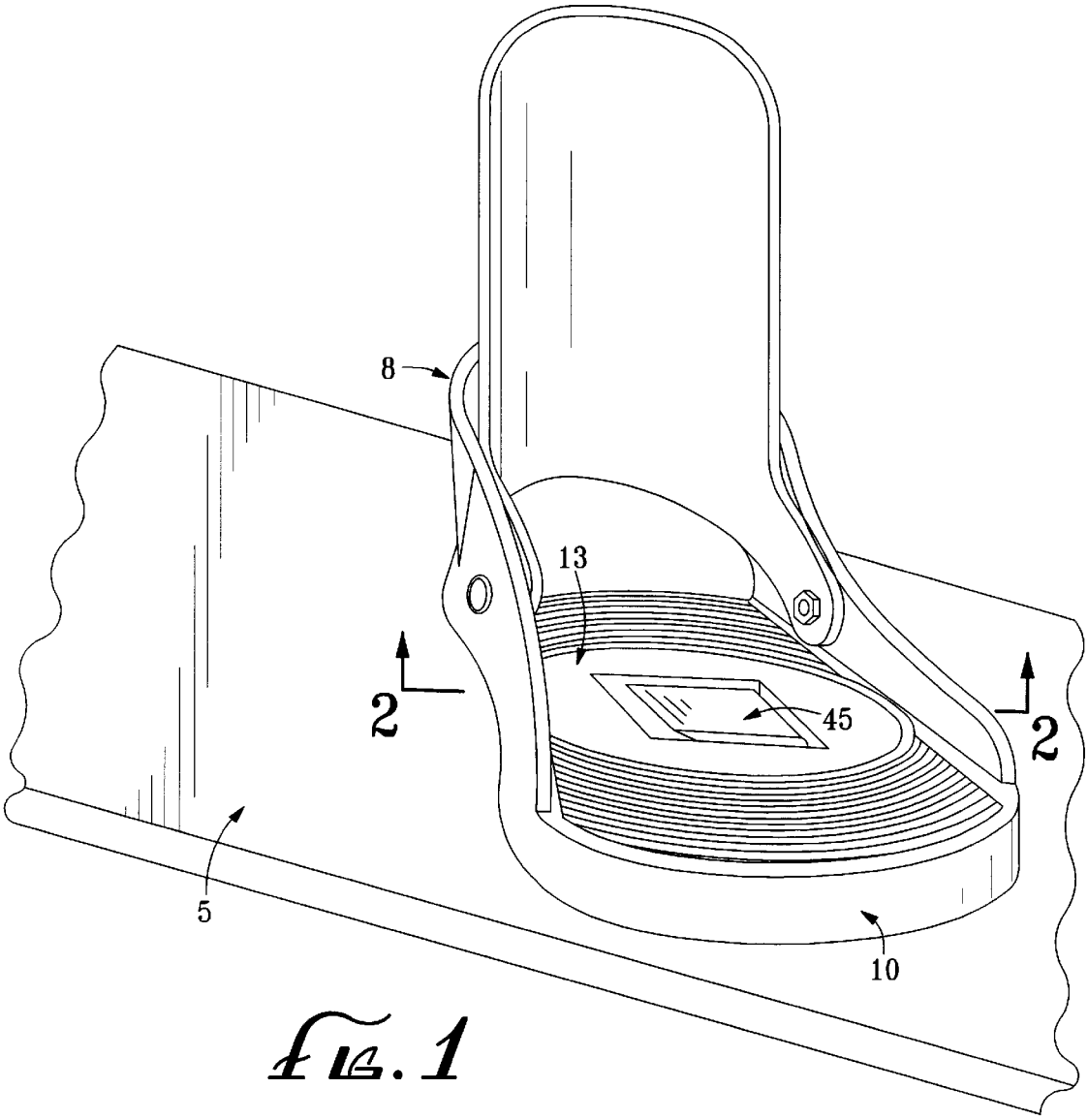
FIG. 1 is a perspective view of a portion of a snowboard in combination with a first embodiment of the present invention.
Figure 2:
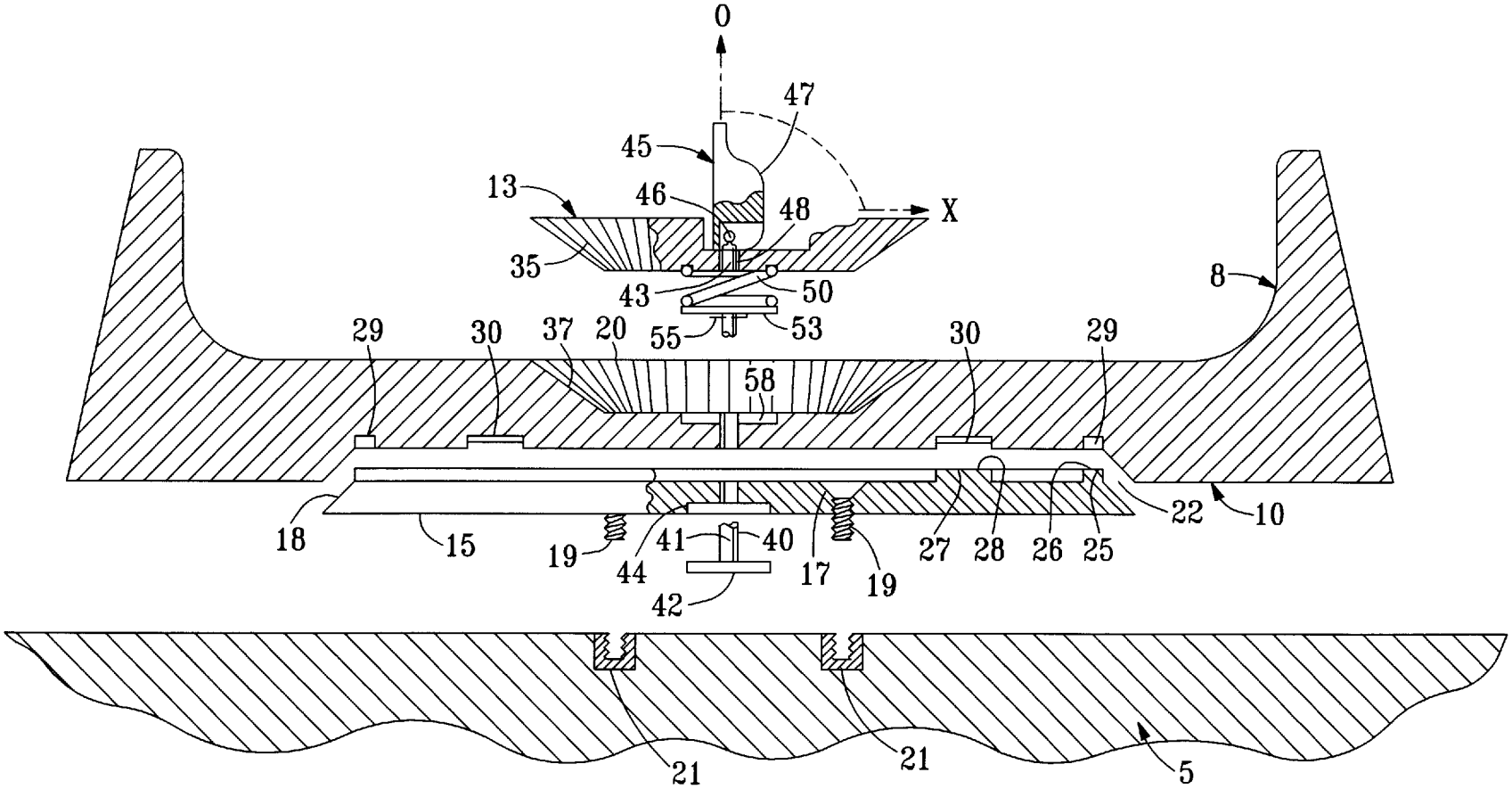
FIG. 2 is an elevation view of the cross-section A—A as defined in FIG. 1.
Figure 3:
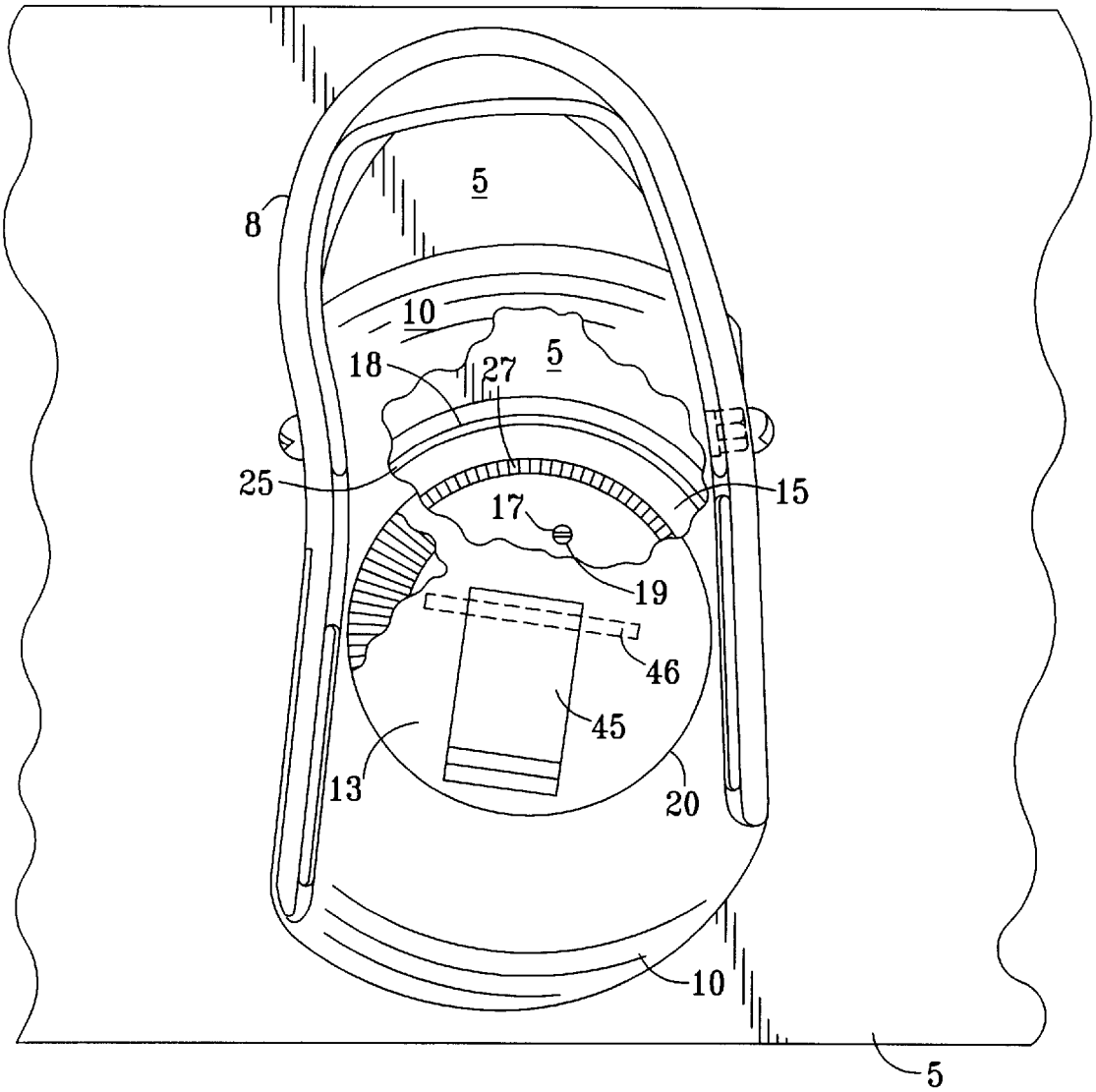
FIG. 3 is a plan view of a first embodiment of the present invention containing a small section cut-away from the top disc and a separate, large section cut-away from both the top disc and the main body.

FIGS. 1–3 show a portion of a snowboard 5 in combination with a boot binding 8 according to a first embodiment of the present invention. The main body 10 of boot binding 8 is engaged from above by top disc 13 and from below by base disc 15. Top disc 13 engages main body 10 at a substantially circular upper cavity 20. Base disc 15 engages main body 10 at a substantially circular lower cavity 22. The centerline of upper cavity 20 is collinear with the centerline of lower cavity 22.

Base disc 15 is mounted to snowboard 5 with one or more screws 19 or similar fastening means. Screw 19 pass through first hole 17 in base disc 15. First hole 17 is countersunk so that the head of screw 19 lie flush with the top of base plate 15. Screw 19 engage threaded insert 21 in snowboard 5.

There are two raised, concentric circular ridges on the top of base disc 15. Outer raised ridge 25 has a smooth upper surface 26 and engages a complementary outer channel 29 in main body 10. Inner raised ridge 27 has teeth along a rough upper surface 28 and engages a complementary inner channel 30 in main body 10. Inner channel 30 has teeth along its upper surface to mate with the teeth on rough upper surface 28 of inner raised ridge 27.

The bottom surface 35 of top disc 13 and the wall 37 of upper cavity 20 may also have complementary teeth which engage upon contact of the two parts.

Top disc 13, main body 10 and base disc 15 are joined by a vertical shaft 40 that runs through the centerlines of both discs and the centerlines of both cavities. Vertical shaft 40 has a lower end 41 and an upper end 43. Vertical shaft 40 terminates at a lower end 41 in a tee 42 beneath base disc 15. Tee 42 is countersunk into an elongated detent 44 in the bottom of base disc 15 to a point where tee 42 does not protrude below base disc 15. Elongated detent 44 is complementary in shape to tee 42 whereby tee 42 is unable to rotate within detent 44.

Vertical shaft 40 terminates at upper end 43 in a first hinged coupling 46. First hinged coupling 46 is attached to a top lever 45. Top lever 45 if free to rotate approximately ninety degrees (90°) between an open position and a closed position. First hinged coupling 46 is rigid in all directions except the axis about which top lever 45 rotates.

Upper end 43 has a non-circular cross-section, preferably square in shape. Upper end 43 passes through top disc 13 at second hole 48. Second hole 48 has a non-circular shape, complementary with the cross-section of upper end 43 whereby top disc 13 is unable to rotate about upper end 43.

A spring 50 lies between main body 10 and top disc 13. When top lever 45 is in the open position, spring 50 is slightly compressed and held against the bottom surface of top disc 13 by washer 53 and circlip 55.

When top lever 45 is moved from the open to the closed position, a first cam 47 on top lever 45 pulls vertical shaft 40 upward. In the closed position, tee 42 is in contact with base disc 15, top lever 45 is in contact with top disc 13, and vertical shaft 40 is in tension, forcing both top disc 13 and base disc 15 against main body 10. Spring 50 is compressed between top disc 13 and main body 10, and lies within countersunk gap 58. The engaged teeth between base disc 15 and main body 10 prevent main body 10 from rotating with respect to base disc 15. Because base disc 15 is rigidly mounted to snowboard 5, main body 10 is also prevented from rotating with respect to snowboard 5.

Where bottom surface 35 of top disc 13 and the wall 37 of upper cavity 20 also have teeth, the engaged teeth between top disc 13 and main body 10 prevent main body 10 from rotating with respect to top disc 13. Top disc 13 is unable to rotate with respect to vertical shaft 40 due to second hole 48, and tee 42 of vertical shaft 40 is unable to rotate with respect to base disc 15 due to elongated detent 44. Thus, main body 10 is unable to rotate with respect to snowboard 5.

When top lever 45 is moved from the closed to the open position, first cam 47 releases the tension in vertical shaft 40 and creates a gap approximately 1/32" to 3/32" between the upper surface of top disc 13 and top lever 45. Spring 50 forces top disc 13 away from main body 10, disengaging the teeth and freeing main body 10 to rotate freely about an axis normal to snowboard 5. The teeth between inner channel 30 and rough upper surface 28 are engaged only by gravity. The gap created by opening top lever 45 is large enough to allow the rider to adjust the angle of main body 10 by hand. Once the rider has selected the desired orientation of main body 10, top lever 45 can be moved from the open position back to the closed position, locking main body 10 in the desired orientation.

Figure 4:
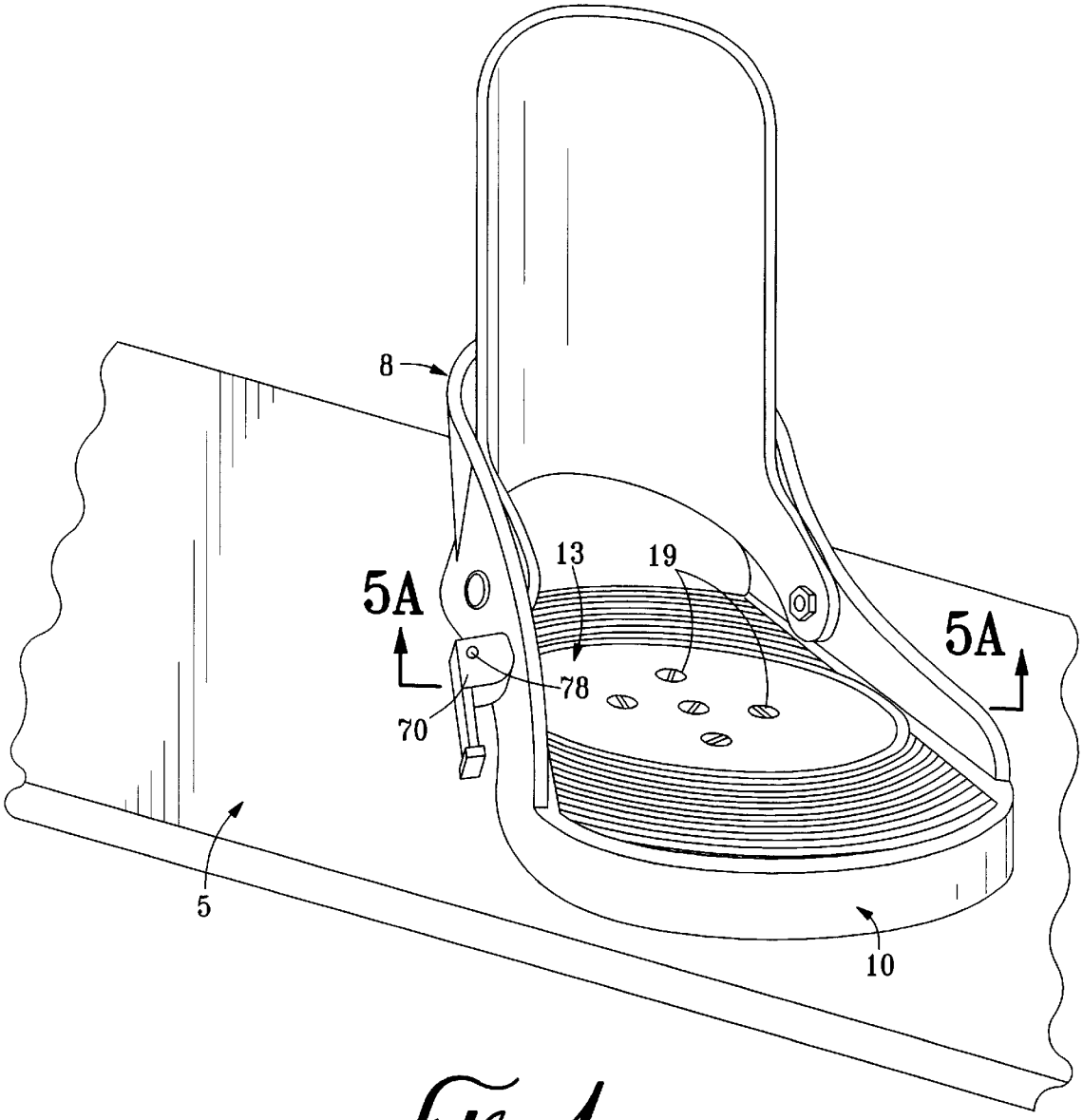
FIG. 4 is a perspective view of a portion of a snowboard in combination with a second embodiment of the present invention.
Figure 5A:
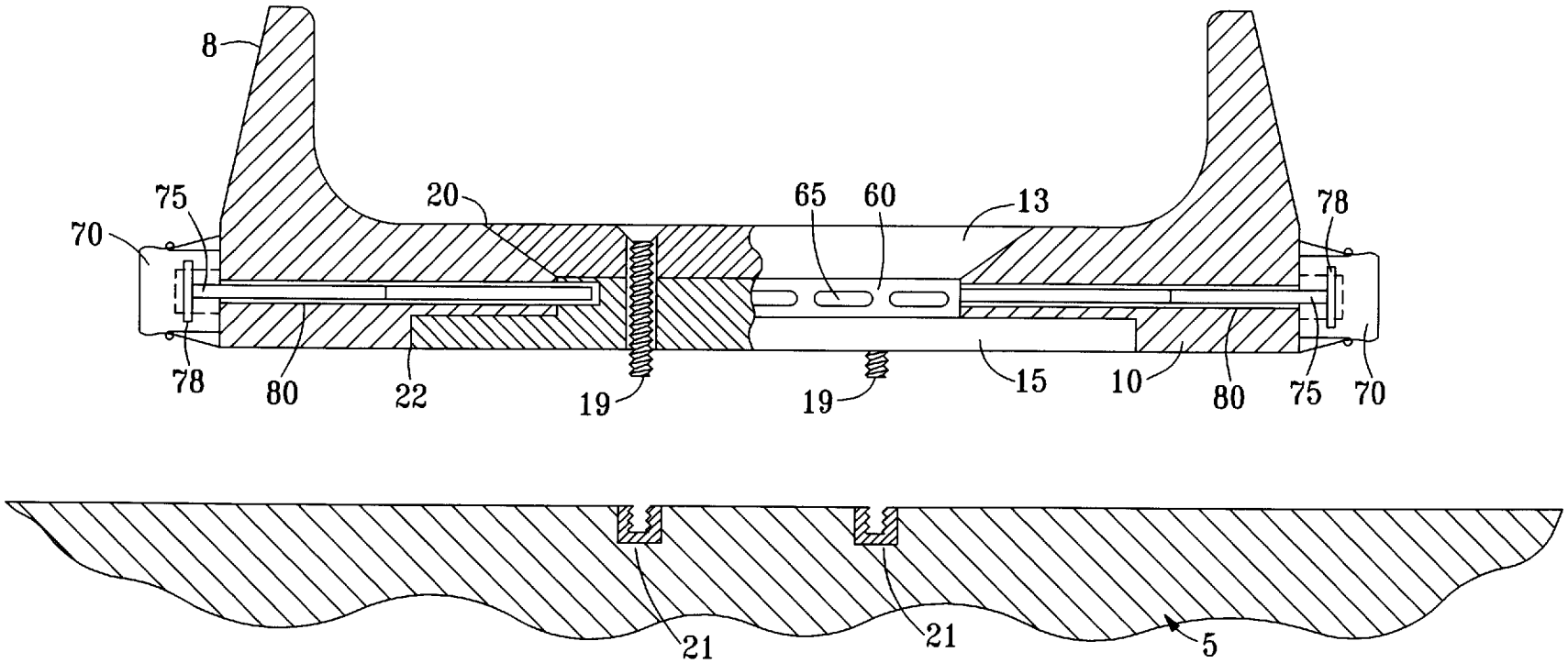
FIG. 5*a* is an elevation view of the cross-section B—B is defined in FIG. 4 according to a first embodiment of the present invention.
Figure 5B:
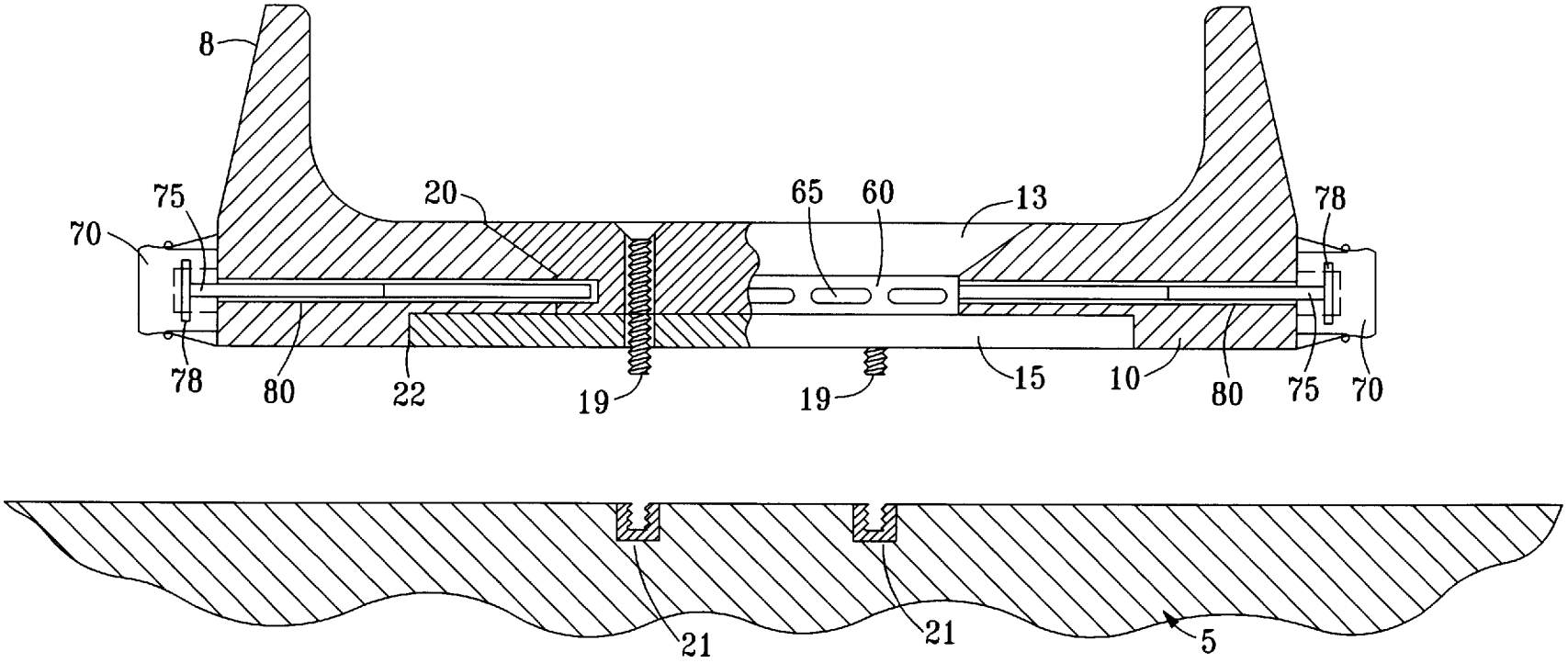
FIG. 5*b* is an elevation view of the cross-section B—B as defined in FIG. 4 according to a second embodiment of the present invention.
Figure 6:
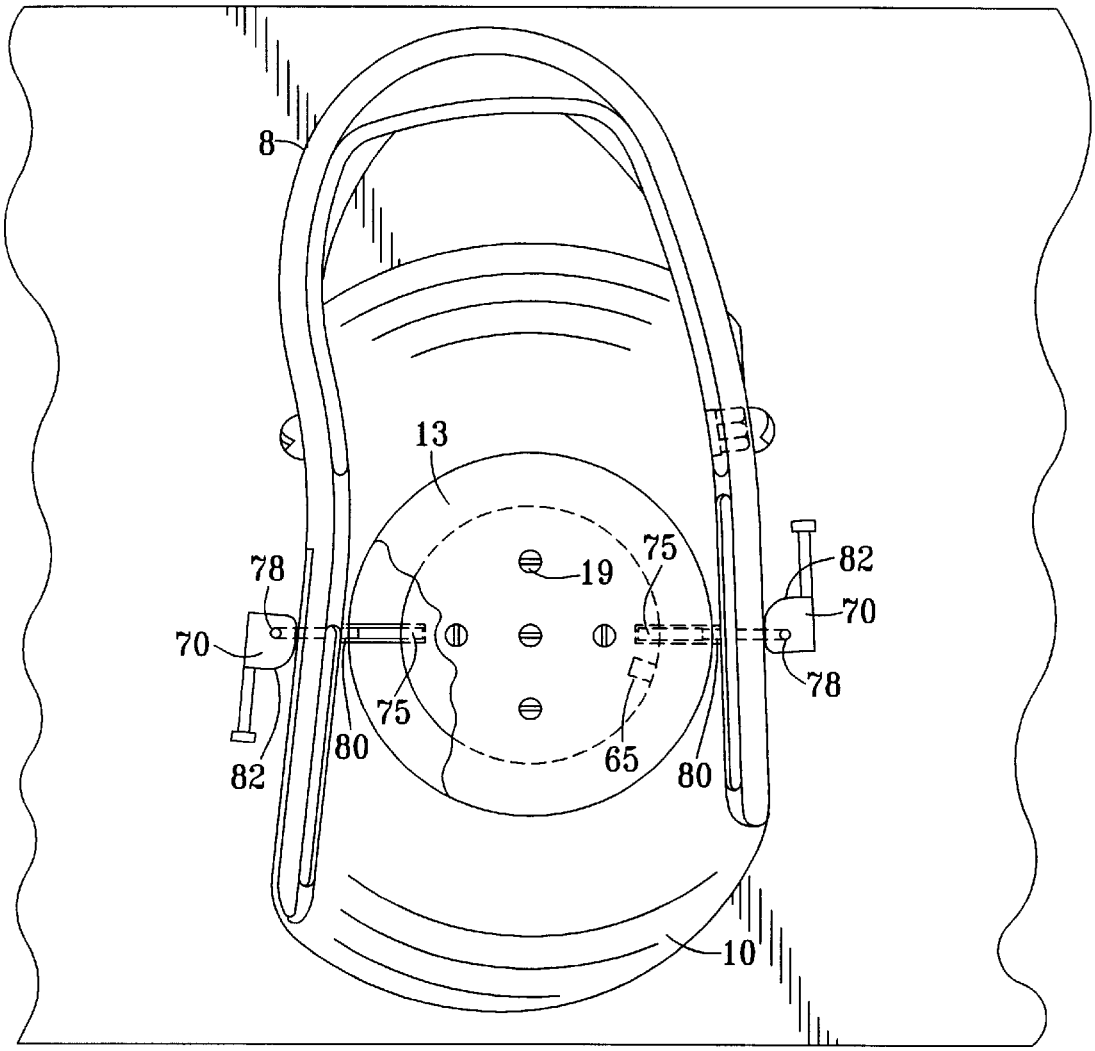
FIG. 6 is a plan view of a second embodiment of the present invention containing a cut-away section.
Figure 7:
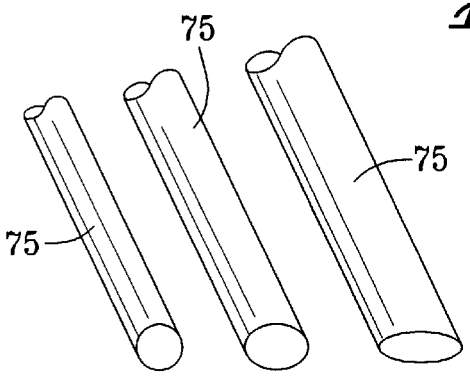
FIG. 7 is a perspective view of the horizontal shaft disclosed in FIGS. 5 and 6, specifying some of the possible cross-sectional shapes.

FIGS. 4–6 show a second embodiment of the invention mounted to a portion of snowboard 5. In this embodiment the contacting surfaces between top disc 13 and main body 10, and between main body 10 and base disc 15 are smooth, allowing main body 10 to rotate freely about an axis normal to the plane of snowboard 5.

Top disc 13 and base disc 15 are rigidly mounted to snowboard 5 with one or more screws 19, or similar fasteners, engaged with inserts 21 in snowboard 5. Main body 10 is held between top disc 13 and base disc 15, preventing movement of main body 10 in all directions except about the axis through the centerlines of the discs and cavities. In its operating position, the top surface of top disc 13 is flush with the top surface of main body 10 and the lower surface of base disc 15 is flush with the bottom surface of main body 10.

As shown in FIG. 5*a,* base disc 15 has a raised central disc 60 with a centerline collinear with the centerline of base disc 15. Central disc 60 has a plurality of orifices 65 extending in a radical direction inward from the perimeter toward its center. Each orifice 65 is approximately 1/8"–3/4", and is of a constant cross-sectional shape, preferably circular or oval. FIG. 5*b* shows an alternate embodiment wherein the orifices are arranged around the perimeter of top disc 13, instead of base disc 15. The spacing, shape and orientation of each orifice 65 is the same for both embodiments.

Two side levers 70 are attached one to each side of main body 10. The side levers 70 are positioned approximately half the distance between the heel and the toe of boot binding 8, on the outside edge of main body 10. Each side lever 70 can be independently rotated over an angle of approximately ninety degrees (90°) from an open position to a closed position.

Each side lever 70 is attached to a horizontal shaft 75 by a second hinged coupling 78. Second hinged coupling 78 allows side lever 70 to rotate about an axis perpendicular to horizontal shaft 75. Horizontal shaft 75 passes through a horizontal channel 80 in main body 10. Horizontal channel 80 runs in a radical direction along a line drawn from the point of contact of side lever 70 with main body 10 to the center of base plate 15. Horizontal shaft 75 has a cross-sectional shape complementary to the shape of orifice 65, preferably circular or oval.

When side lever 70 is in the closed position, the end of horizontal shaft 75 opposite second hinged coupling 78 terminates inside orifice 65. Horizontal shaft 75 has a cross-section complementary to the cross-section of horizontal channel 80. Depending on the orientation of main body 10 selected by the snowboarder, one of the plurality of orifices 65 lines up with horizontal channel 80. The interference of horizontal shaft 75 with horizontal channel 80 and orifice 65 prevents main body 10 from rotating.

When side lever 70 is moved from the closed position to the open position, second cam 82 moves horizontal shaft 75 toward side lever 70, drawing horizontal shaft 75 entirely out of orifice 65. In this position, main body 10 is free to rotate about an axis normal to snowboard 5. Once the snowboarder has selected an orientation for main body 10, side levers 70 can be moved into the closed position, preventing main body 10 from rotating.

Although a limited number of embodiments of the invention have been illustrated and described, various alternatives, modifications and equivalents may be used. Therefore, the foregoing description should not be taken as limiting the scope of the inventions which are defined by the appended claims.

What is claimed is:

1. A snowboard boot binding comprising:

a unitary main body having an upper cavity and a lower cavity, said main body forming the base of a binding in which a boot can be firmly held, said upper cavity and said lower cavity having circular cross-sections and a common centerline;

a base disc engaging said main body from below at said lower cavity, the shape of said base disc being complementary to the shape of said lower cavity;

a top disc engaging said main body from above at said upper cavity, the shape of said top disc being complementary to the shape of said upper cavity;

a fastening means for rigidly attaching said base disc to a snowboard; and a locking means for releasably interlocking said main body with said base disc whereby said main body is prevented from rotating with respect to said base disc;

wherein said locking means comprises:

a plurality of orifices arranged about the perimeter of said base disc;

a horizontal channel in said main body having a cross-sectional shape substantially the same as that of said orifices, said horizontal channel extending from a point adjacent to said base disc to a point external to said main body;

a horizontal shaft having a cross-sectional shape complementary with the cross-sectional shape of said horizontal channel, said horizontal shaft having a first end terminating within said horizontal channel and a second end terminating at a second hinged coupling; and a first side lever linked to said second hinged coupling, said first side lever having a cam whereby angular rotation of said first side level moves said horizontal shaft into one of said orifices, preventing said main body from rotating with respect to said base disc.

2. A snowboard boot binding comprising:

a unitary main body having an upper cavity and a lower cavity, said main body forming the base of a binding in which a boot can be firmly held, said upper cavity and said lower cavity having circular cross-sections a common centerline;

a base disc engaging said main body from below at said lower cavity, the shape of said base disc being complementary to the shape of said lower cavity, said base disc having a plurality of orifices about its perimeter;

a top disc engaging said main body from above at said upper cavity, the shape of said top disc being complementary to the shape of said upper cavity;

a fastening means for rigidly attaching said base disc to a snowboard;

a horizontal channel in said main body having a cross-sectional shape equal to that of said orifices, said horizontal channel extending from a point adjacent to said base disc to a point external to said main body;

a horizontal shaft having a cross-sectional shape complementary with the cross-section of said horizontal channel, said horizontal shaft having a first end terminating within said horizontal channel and a second end terminating in a second hinged coupling; and a first side lever linked to said second hinged coupling, said first side lever having a cam whereby angular rotation of said first side lever moves said horizontal shaft into one of said orifices, preventing said main body from rotating with respect to said base disc.

3. A snowboard boot binding according to claim 2 wherein said horizontal shaft has an oval cross-section.

4. A snowboard boot binding according to claim 2 in combination with a second side lever opposite said first side lever, said second side lever being incorporated into said snowboard boot binding in the exact manner, and performing the exact function, as said first side lever.

5. A snowboard boot binding according to claim 2 wherein said orifices are arranged about the circumference of said top disc.

6. A snowboard boot binding according to claim 2 wherein said wherein said top disc, said main body and said base disc are plastic.

7. A snowboard boot binding according to claim 2 wherein said horizontal shaft is metallic.

8. A snowboard boot binding according to claim 2 wherein said horizontal shaft has a circular cross-section.

* * * * *